US005300986A

United States Patent [19]

Mishra et al.

[11] Patent Number: 5,300,986

[45] Date of Patent: Apr. 5, 1994

[54] ELECTRICALLY TUNABLE CHARGING DEVICE FOR DEPOSITING UNIFORM CHARGE POTENTIAL

[75] Inventors: Satchidanand Mishra, Webster; Edward A. Domm; Denis C. Thomas, both of Hilton, all of N.Y.

[73] Assignee: Xerox Corporation, Stamford, Conn.

[21] Appl. No.: 991,910

[22] Filed: Dec. 17, 1992

[51] Int. Cl.[5] ..... G03G 15/02

[52] U.S. Cl. ..... 355/221; 355/219

[58] Field of Search ..... 355/221, 222, 225, 219, 355/208; 250/324, 325, 326

[56] References Cited

U.S. PATENT DOCUMENTS

| | | | |
|---|---|---|---|
| 2,777,957 | 1/1957 | Walkup | 250/49.5 |
| 2,965,754 | 12/1960 | Bickmore et al. | 250/49.5 |
| 3,937,960 | 2/1976 | Matsumoto et al. | 250/326 |
| 4,112,299 | 9/1978 | Davis | 250/326 |
| 4,284,697 | 8/1981 | Ando et al. | 355/219 X |
| 4,318,610 | 3/1982 | Grace . | |
| 4,456,365 | 7/1984 | Yuasa . | |
| 4,603,964 | 8/1986 | Swistak | 355/225 |
| 4,638,397 | 1/1987 | Foley | 361/212 |
| 4,695,723 | 9/1987 | Minor | 250/325 |
| 4,811,045 | 3/1989 | Matsushita et al. | 355/225 |
| 4,835,571 | 5/1989 | Tagawa et al. | 355/225 |
| 5,008,707 | 4/1991 | Ewing et al. | 355/225 X |
| 5,018,045 | 5/1991 | Myochin et al. | 250/324 X |
| 5,025,155 | 6/1991 | Hattori | 250/326 |
| 5,087,944 | 2/1992 | Yamauchi | 355/225 |
| 5,206,784 | 4/1993 | Kimiwada et al. | 355/225 X |

OTHER PUBLICATIONS

*Electrophotography*, Schaffert, Focal Press, London, (1971).

"Photoreceptor Charging Scorotron"; Swistak, Xerox Disclosure Journal, vol. 10, No. 3, May/Jun. 1985, pp. 139-141.

"Micrometer Adjustment for Inboard-Outboard Balancing of Scorotron Charge Devices" Paskus et al, Xerox Disclosure Journal, vol. 17, No. 3, May/Jun. 1992, pp. 139-140.

*Primary Examiner*—A. T. Grimley
*Assistant Examiner*—Sandra L. Brasé
*Attorney, Agent, or Firm*—Duane C. Basch

[57] ABSTRACT

The present invention is a charging apparatus capable of electrically tuning or altering, on a relatively local scale, the corona ion current passing between a corona producing device and a charge retentive surface. The charging apparatus, which may be either a corotron or a scorotron, is specifically adapted to apply a uniform charge to a charge retentive surface which characteristically exhibits non-uniform charging behavior. More specifically, the charging apparatus comprises corona producing devices, spaced apart from the charge retentive surface, for emitting a corona ion current, and device, responsive to a bias voltage, for locally altering the corona ion current passing between said corona producing device and the charge retentive surface. In the described embodiments, the ion current altering device includes segmented grids, segmented shields and segmented electrodes, all of which may be maintained at variable bias voltages to produce local variation in the ion current passing to the charge retentive surface.

14 Claims, 10 Drawing Sheets

ELECTRICALLY TUNABLE CHARGING DEVICE FOR DEPOSITING UNIFORM CHARGE POTENTIAL

This invention relates generally to a scorotron charging device, and more particularly to an electrically adjustable scorotron that produces a uniform charge on a charge retentive surface.

CROSS REFERENCE

The following related application is hereby incorporated by reference for its teachings:

U.S. patent application Ser. No. 992,512 to Mishra et al., entitled "Tunable Scorotron for Depositing Uniform Charge Potential,", filed concurrently herewith.

BACKGROUND AND SUMMARY OF THE INVENTION

The present invention controls the uniformity and magnitude of corona charging of a charge retentive, photoresponsive surface. A scorotron is similar to a corotron, but makes use of an open screen grid as a control electrode, to establish a reference potential, so that when the receiver surface reaches the grid's reference potential, the corona generated electric fields no longer drive ions to the receiver, but rather to the grid. Many factors can contribute to charge nonuniformity across the surface of a photoresponsive member. For example, nonuniformity in the thickness of the photoresponsive layers and edge effects both impact the charging characteristics of a photoresponsive member. Furthermore, nonuniformity in charging characteristics, particularly the charge density and the charge potential, can be exacerbated by the charging device utilized, as well as by aging of the photoresponsive member, where higher charge levels are needed to produce a desired potential on the photoresponsive surface.

As represented by the simplified corotron illustrated in FIG. 1, it is well known to surround corona wire 104, by a grounded shield, 106. Moreover, it is known that the resulting ion current flowing to the surface of photoreceptor 20, represented by $I_p$, can be represented by the following equation:

$$I_p = I_c - I_e, \qquad \text{Eq. 1}$$

where $I_c$ is the ion current emitted from corona wire 104, and $I_e$ is the current flowing through grounded shields 106. Similarly, as illustrated in FIG. 2, the addition of shield bias voltage $V_B$, and scorotron grid 108, having bias voltage $V_G$ applied thereto, will result in a modified ion current flowing to the photoreceptor surface. The modified photoreceptor ion current, $I_p'$, is represented as follows:

$$I_p' = I_p - I_g, \qquad \text{Eq. 2}$$

where $I_g$ is the ion current which is drained off by the biased scorotron grid. Further derivation of the equations for the specific currents as a function of the applied or bias voltage and geometry are described by R. M. Schaffert in *Electrophotography*, Focal Press, London (1971), the relevant portions of which are hereby incorporated by reference.

Heretofore, numerous variations of corotron and scorotron charging systems have been developed employing the principles represented in FIGS. 1 and 2, of which the following disclosures may be relevant:

U.S. Pat. No. 2,777,957, Patentee: Walkup, Issued: Jan. 15, 1957.

U.S. Pat. No. 2,965,754, Patentee: Bickmore et al, Issued: Dec. 20, 1960.

U.S. Pat. No. 3,937,960, Patentee: Matsumoto et al., Issued: Feb. 10, 1976.

U.S. Pat. No. 4,112,299, Patentee: Davis, Issued: Sep. 5, 1978.

U.S. Pat. No. 4,456,365, Patentee: Yuasa, Issued: Jun. 26, 1984.

U.S. Pat. No. 4,638,397, Patentee: Foley, Issued: Jan. 20, 1987.

U.S. Pat. No. 5,025,155, Patentee: Hattori, Issued: Jun. 18, 1991.

Xerox Disclosure Journal, Vol. 10, No. 3, May/June 1985.

Xerox Disclosure Journal, Vol. 17, No. 4, July/August 1992.

The relevant portions of the foregoing patents may be briefly summarized as follows:

U.S. Pat. No. 2,777,957 discloses a corona discharge device for electrically charging an insulating layer. A conductive grille is interposed between the ion source, for example, the corona discharge electrode, and the insulating layer, preferably a photoconductive insulating layer. The grille is maintained at a potential below the voltage of the corona discharge electrode and produces a uniform charge potential across the insulating layer.

U.S. Pat. No. 2,965,754 describes a double screen corona device having a pair of corona screens to substantially eliminate charge nonuniformity, referred to as charge streaking. The screens, inserted between the corona element and an insulating layer, are arranged in a parallel fashion overlapping one another so as to diffuse the ions emitted by the corona element before they are deposited on an insulating layer. Both screens may be maintained at slightly different potentials, however, the screen closest to the insulating layer is maintained at a potential between four and ten times the maximum potential to which the insulating layer is to be raised.

U.S. Pat. No. 3,937,960 discloses a charging device for an electrophotographic apparatus having a movable control plate. The control plate, commonly referred to as a shield, is formed of a flexible conductive material. The control plate may be moved relative to a corona producing wire, such that the movement of the plate produces a corresponding variation in the ion flow from the wire.

U.S. Pat. No. 4,112,299 teaches a corona charging device having an elongated wire and a surrounding conductive shield which is segmented in a direction parallel to the wire. Each of the conductive shield segments may be biased at different potentials in order to produce a universal corona generating device which is adaptable to a variety of situations.

U.S. Pat. No. 4,456,365 discloses a corona charging device for uniformly charging an image forming member which includes a corona wire and a conductive shield which partially surrounds the wire. The image forming member is uniformly charged by applying an AC voltage to the corona wire, along with an additional DC bias voltage.

U.S. Pat. No. 4,638,397 describes a scorotron where the wire grid is connected to ground via a plurality of Zener diodes and a variable resistor. The control circuit employed effectively limits the charge potential which is deposited on a photoconductive layer by varying the voltage applied to a control grid as a fraction of the nominal voltage applied to the grid.

U.S. Pat. No. 5,025,155 teaches a corona charging device for charging the surface of a moving member which includes a plurality of corona generating electrodes and a grid electrode located between the moving member and the wire electrodes. Increased surface potential is achieved on the moving member utilizing a plurality of wire electrodes, where the distance between the grid electrode and the moving member is shortest beneath the downstream electrode.

Xerox Disclosure Journal (Vol. 10, No. 3; May/June 1985) teaches, at pp. 139–140, a charging scorotron employing a scorotron grid which is segmented on one end thereof in order to selectively avoid the creation of unused charged areas on an adjacent photoreceptor. The two disclosed segments at the end of the scorotron are switchably connected to a potential source so that in all cases the photoreceptor width corresponding to the image size of the smallest copy sheet is always charged.

Xerox Disclosure Journal (Vol. 17, No. 4; July/August 1992) describes, at pp. 239–240 a corrugated scorotron screen having corrugations which run orthogonal to the process direction of a charge receptor. As noted, the added strength and rigidity provided by the corrugations within the screen help to maintain flatness and rigidity of the screen.

In accordance with the present invention, there is provided a charging apparatus adapted to apply a uniform charge to a charge retentive surface. The scorotron apparatus comprises corona producing means, spaced apart from the charge retentive surface, for emitting a corona ion current and means, responsive to a bias voltage, for locally altering the corona ion current passing between said corona producing means and the charge retentive surface.

In accordance with another aspect of the present invention, there is provided an electrophotographic imaging apparatus for producing a toned image, including a photoconductive member, means for charging a surface of said photoconductive member to produce a uniform charge density across a surface thereof, means for exposing the charged surface of said photoconductive member to record an electrostatic latent image thereon, and means for developing the electrostatic latent image recorded on said photoconductive member with toner to form a toned image thereon. The charging means includes corona producing means, spaced apart from the surface of said photoconductive member, for emitting a corona ion current and means for locally altering the corona ion current passing between said corona producing means and the surface of said photoconductive member.

BRIEF DESCRIPTION OF THE DRAWINGS

FIG. 10 is a graph illustrating expected voltage and charge profiles across the surface of the photoreceptor depicted in FIG. 8 using an ideal scorotron device, while

The present invention will be described in connection with a preferred embodiment, however, it will be understood that there is no intent to limit the invention to the various embodiments described. On the contrary, the intent is to cover all alternatives, modifications, and equivalents as may be included within the spirit and scope of the invention as defined by the appended claims.

DESCRIPTION OF THE PREFERRED EMBODIMENT

Figure 12:
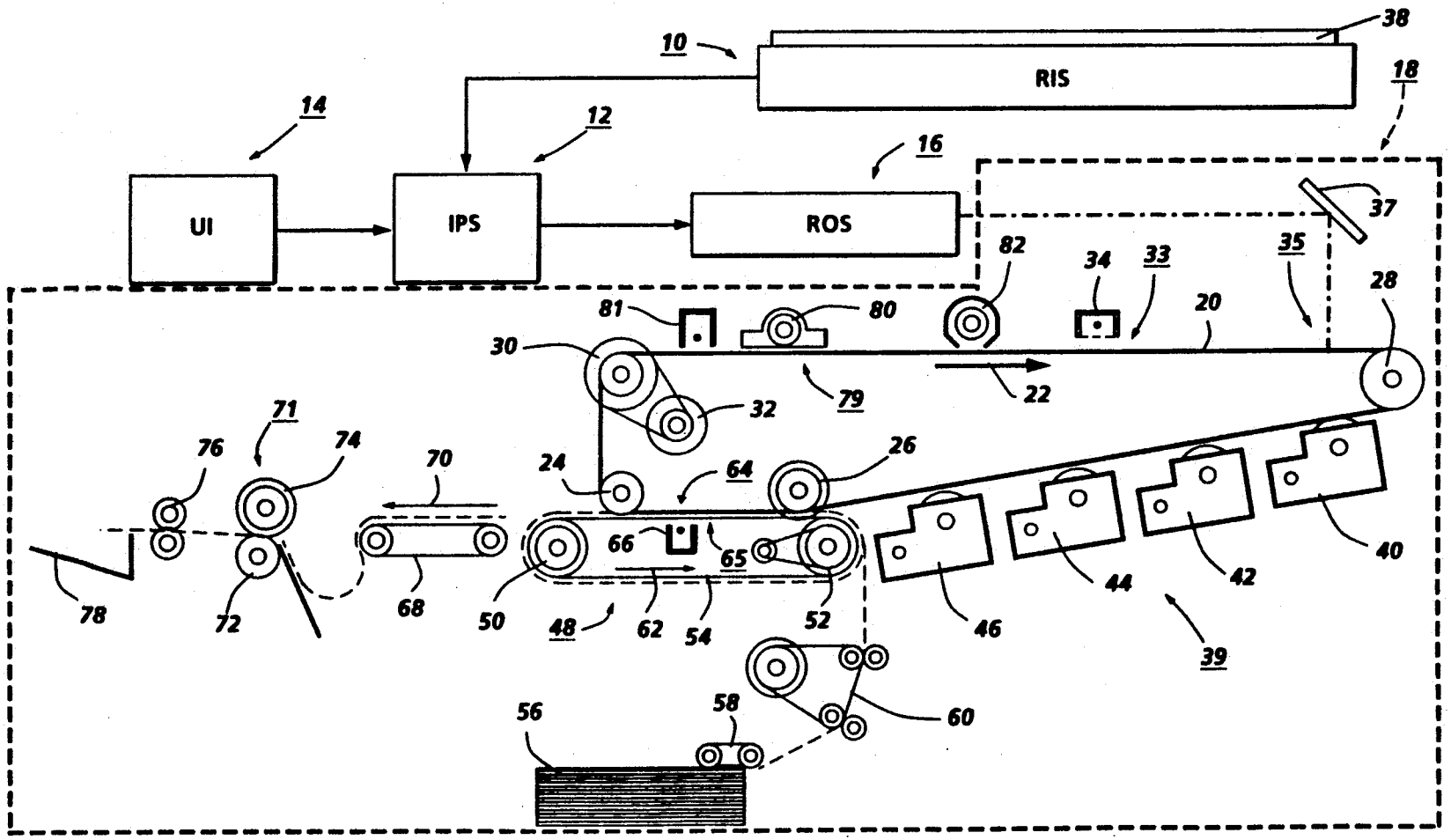
FIG. 12 is a schematic elevational view showing an electrophotographic printing machine incorporating the features of the present invention therein.

For a general understanding of the present invention, reference is made to the drawings. In the drawings, like reference numerals have been used throughout to designate identical elements. FIG. 12 shows a schematic elevational view of an electrophotographic printing machine incorporating the features of the present invention therein. It will become evident from the following discussion that the present invention is equally well suited for use in a wide variety of printing systems, and is not necessarily limited in its application to the particular system shown herein.

Turning first to FIG. 12, during operation of the printing system, a multicolor original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it into a series of raster scan lines and, moreover, measures a set of primary color densities (i.e. red, green and blue densities) at each point of the original document. This information is transmitted as electrical signals to an image processing system (IPS), indicated generally by the reference numeral 12. IPS 12 converts the set of red, green and blue density signals to a set of colorimetric coordinates. The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image.

ROS 16 includes a laser with rotating polygon mirror blocks. The ROS illuminates, via mirror 37, the charged portion of a photoconductive belt 20 of a printer or marking engine, indicated generally by the reference numeral 18, at a resolution of about 400 pixels per inch, to achieve a set of subtractive primary latent images. The ROS will expose the photoresponsive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multicolored image on the copy sheet. This multicolored image is then fused to the copy sheet forming a color copy.

With continued reference to FIG. 12, printer or marking engine 18 is an electrophotographic printing machine. Photoresponsive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22. The speed of the belt is monitored in conventional fashion, and directly controlled by motor 32.

Describing now the operation of the printing engine, initially, a portion of photoconductive belt 20 passes through a charging station, indicated generally by reference numeral 33. At charging station 33, a charging apparatus 34, preferably a scorotron, charges photoconductive belt 20 to a relatively high, substantially uniform potential. Specific details of scorotron 34 will be further described with respect to the remaining drawing figures. Alternatively, it would also be possible to utilize a corotron, which employs aspects of the present invention, to achieve uniform charging of the photoconductive surface on the belt.

Next, the charged photoconductive surface is rotated to an exposure station, indicated generally by the reference numeral 35. Exposure station 35 receives a modulated light beam corresponding to information derived by RIS 10 having a multicolored original document 38 positioned thereat. The modulated light beam impinges on the surface of photoconductive belt 20. The beam illuminates the charged portion of photoconductive belt to form an electrostatic latent image. The photoconductive belt is exposed at least three times to record latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type commonly known as "magnetic brush development units." Typically, a magnetic brush development system employs a magnetizable developer material including magnetic carrier granules having toner particles adhering triboelectrically thereto. The developer material is continually advanced through a directional flux field to form a brush of developer material. The developer material is constantly moving so as to continually provide the brush with fresh developer material.

Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced, or discharged, to a voltage level ineffective for development. The remaining charged areas are then made visible by having developer unit 40 apply green absorbing (magenta) toner particles onto the electrostatic latent image recorded on photoconductive belt 20, as is commonly referred to as charged area development. Similarly, during a subsequent development cycle, a blue separation is developed by developer unit 42 with blue absorbing (yellow) toner particles, while during yet another development cycle the red separation is developed by developer unit 44 with red absorbing (cyan) toner particles. Developer unit 46 contains black toner particles and may be used to develop the electrostatic latent image formed from a black and white original document, or that portion of the color image determined to be representative of black regions. Each of the developer units is moved into and out of an operative position. In the operative position, the magnetic brush is positioned substantially adjacent the photoconductive belt, while in the nonoperative position, the magnetic brush is spaced apart therefrom. More specifically, in FIG. 12, developer unit 40 is shown in the operative position with developer units 42, 44 and 46 being in nonoperative positions. During development of the color separations associated with each of the electrostatic latent image, only one developer unit is in the operative position, the remaining developer units are in the nonoperative position. This insures that each electrostatic latent image is developed with toner particles of the appropriate color without commingling.

After development, the toner image is moved to a transfer station, indicated generally by the reference numeral 65. Transfer station 65 includes a transfer zone 64, where the toner image is transferred to a sheet of support material, such as plain paper. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet is advanced from a stack of sheets 56 disposed on a tray. A friction retard feeder 58 advances the uppermost sheet from stack 56 onto a pre-transfer transport 60. Transport 60 advances the sheet to sheet transport 48 in synchronism with the movement of the sheet gripper. In this way, the leading edge of a sheet arrives at a preselected position, i.e. a loading zone, to be received by the open sheet gripper. The leading edge of the sheet is secured releasably by the sheet gripper. As belts 54 move in the direction of arrow 62, the sheet moves into contact with the photoconductive belt, in synchronism with the toner image developed thereon. In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under-color or black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to vacuum conveyor 68 which transports the sheet, in the direction of arrow 70, to fusing station 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Cleaning station 79 may also employ pre-clean corotron 81, in association with brush 80, to further neutralize the electrostatic forces which attract the residual toner particles to belt 20, thereby improving the efficiency of the fibrous brush. Thereafter, lamp 82 illuminates photoconductive belt 20 to remove any residual charge remaining thereon prior to the start of the next successive cycle.

Figure 1:
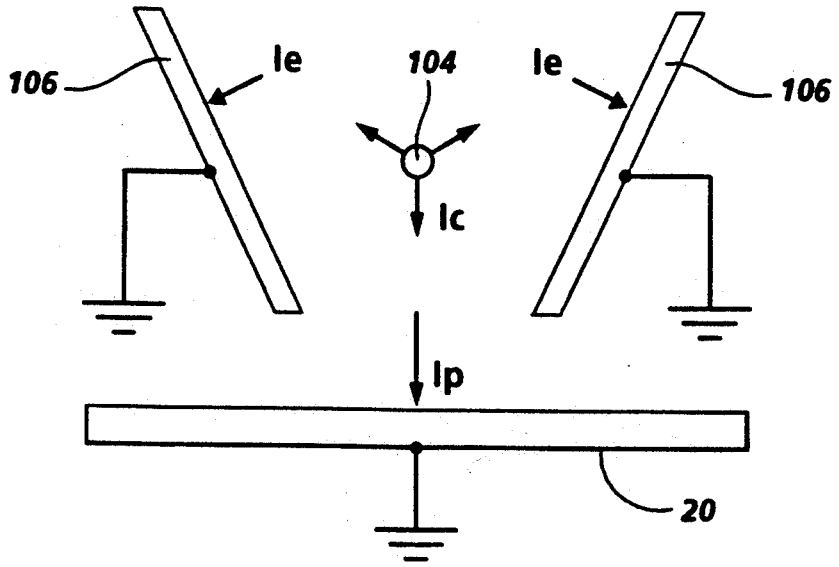
FIGS. 1 and 2 are schematic illustrations of commonly known corotron and scorotron charging systems.
Figure 2:
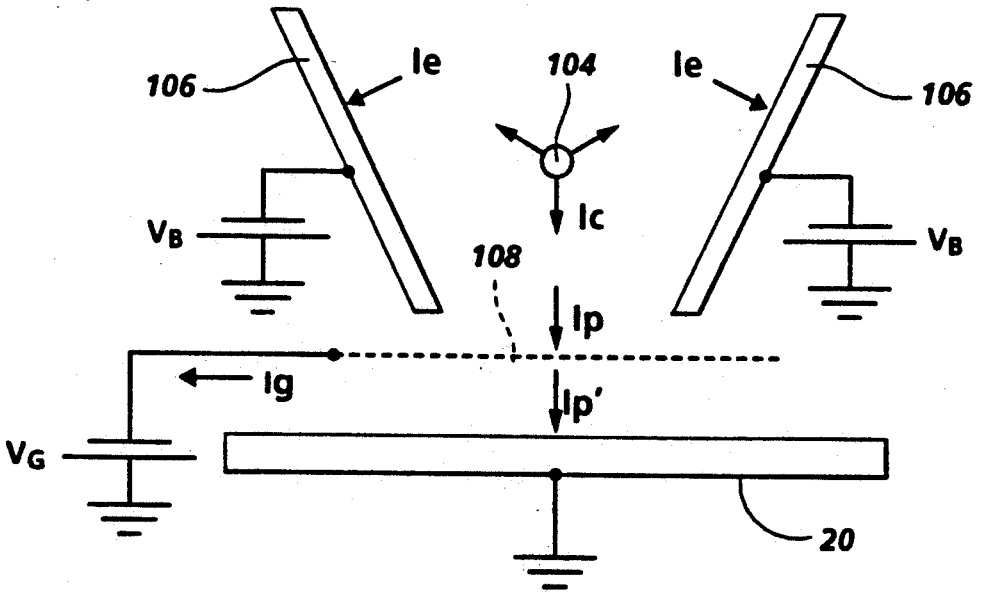
Figure 3:
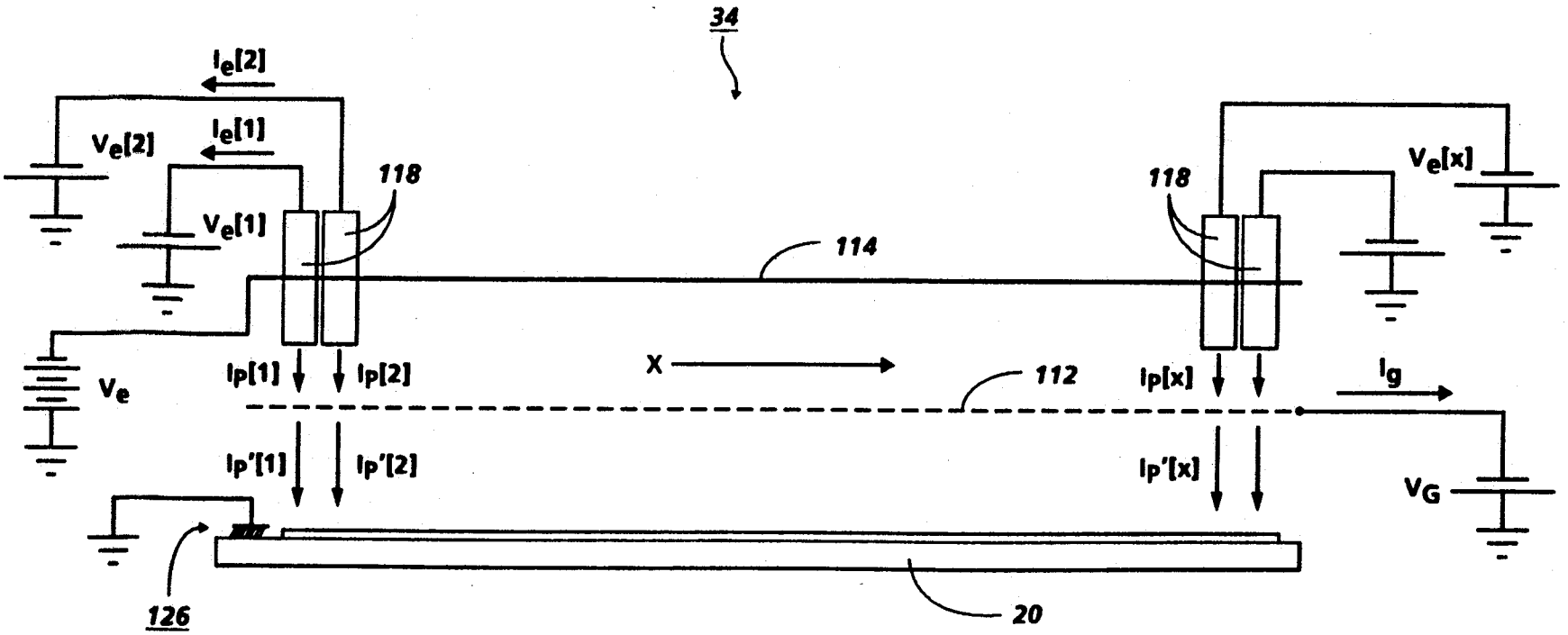
FIG. 3 is a schematic illustration of one embodiment of the present invention.
Figure 4:
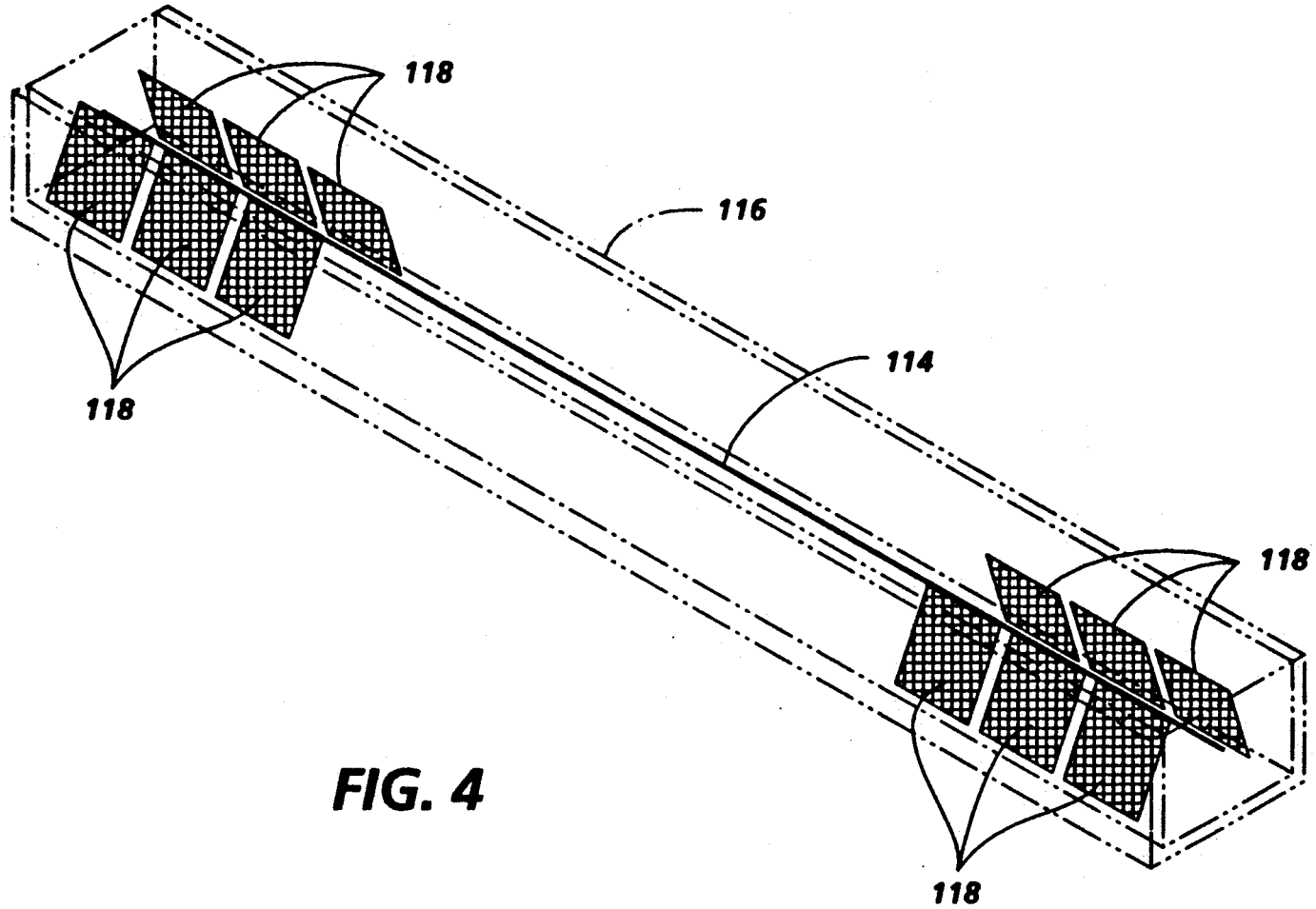
FIG. 4 is a perspective view of the embodiment depicted schematically in FIG. 3.

Referring now to FIG. 3 which, in conjunction with FIG. 4, depicts various elements of a first embodiment of the present invention, scorotron 34 is essentially comprised of a grid 112, and a corona generating element 114 enclosed within a U-shaped shield 116. Grid 112 may be made from any planar conductive, perforated material, and is preferably formed from a thin metal film having a pattern of regularly spaced perforations opened therein. As illustrated, corona generating element 114 is a commonly known wire or thin rod-like member, however, a variety of comb-shaped pin arrangements may also be employed as the corona generating element. The three primary elements of electrically tunable scorotron, 34; the grid, the surrounding shield, and the corona generating element, are maintained in electrical isolation from one another so as to prevent electrical current from flowing directly from one to another. Similarly, charging device 34 may also be embodied as a corotron, by simply removing grid 112 and operating the device in a manner similar to that described in the following description to achieve uniform charging of the surface of belt 20, with minor distinctions as are noted.

A high voltage potential, $V_C$, is applied to corona element 114, while the grid potential, $V_G$, is maintained in the range of the desired photoreceptor charge level. Although not specifically illustrated, it is to be understood that shield 116 is typically grounded for safety reasons. However, the shield may be maintained at a higher voltage potential, to improve the efficiency of the charging apparatus, by preventing a significant reduction of the ion current flowing toward the photoreceptor. Located along both sides of corona element 114 are electrodes or plates 118, the electrodes being arranged in pairs which oppose one another. Each of the electrodes within an aligned pair are connected electrically to a common power supply and are maintained at the same potential. For example, a first electrode pair, referred to as pair 1, would be connected to a power supply having voltage $V_e[1]$, a second pair voltage $V_e[2]$, and so on so that any electrode pair may be represented as having a voltage $V_e[x]$, where x is the position of the plate pair from an end of the scorotron.

Electrical isolation of the plates is achieved in the present embodiment by an air gap maintained therebetween, resulting in the individual plate pairs, in conjunction with the applied voltage $V_e[x]$, causing only a localized variation in the corona current. Returning to Equation 1, presented earlier, the localized representation of the ion current being deposited on photoreceptor 20, represented as $I_p'[x]$, may be determined as follows:

$$I_p'[x]=I_p[x]-I_g, \qquad \text{Eq. 3}$$

where $$I_p[x]=I_c-I_s-I_e[x], \qquad \text{Eq. 4}$$

and where $I_s$ is the current flow to surrounding shield 116, and $I_e[x]$ is the localized representation of the ion current flowing to electrode pair x. Furthermore, because $I_e[x]$ is a function of the bias voltage, $V_e[x]$, applied to a pair of electrodes, by merely altering the bias voltage, the resultant ion current flow to a localized region on the surface of photoreceptor 20 can be adjusted.

Figure 5:
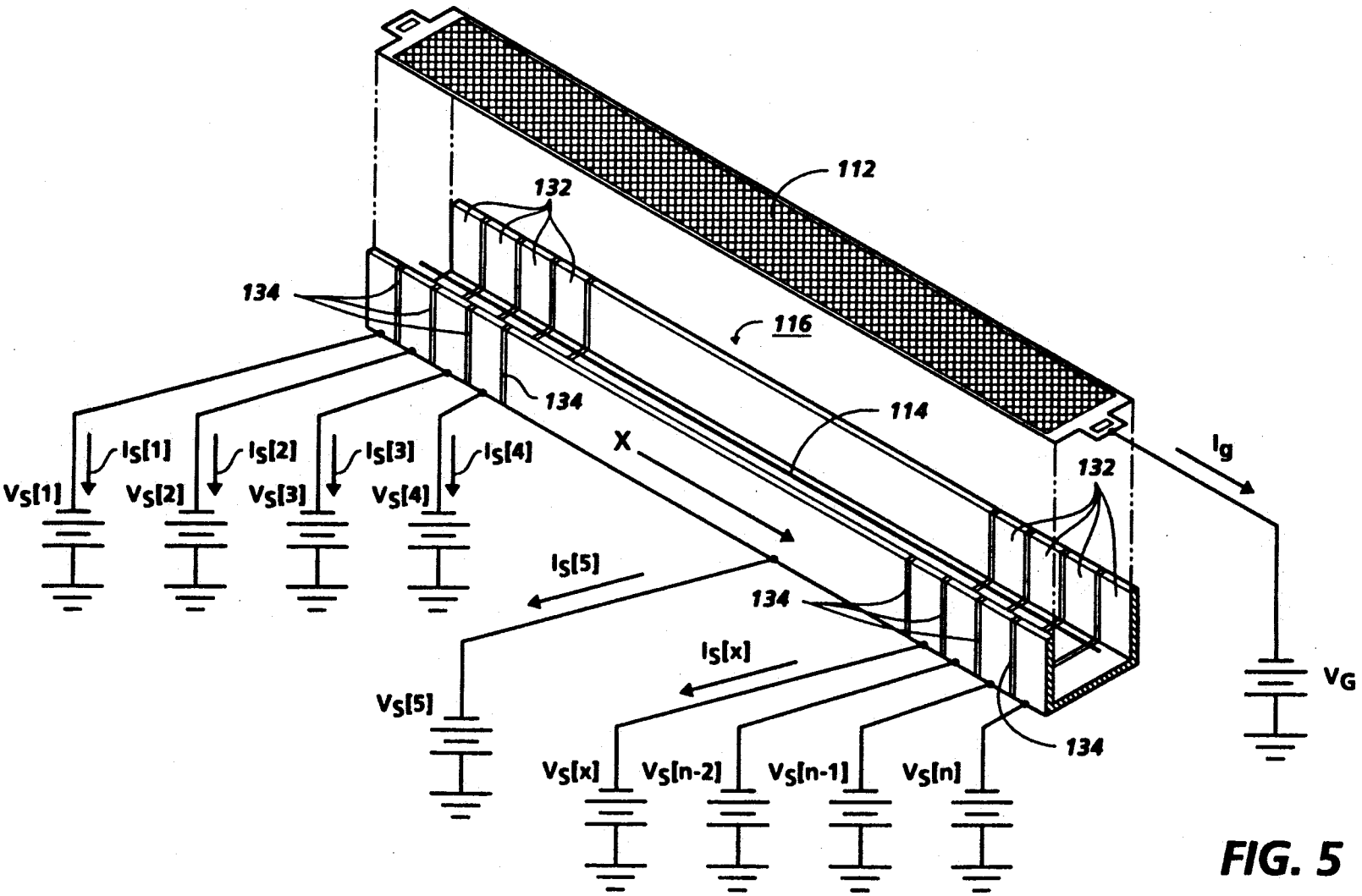
FIG. 5 is a perspective view of an alternative embodiment of the present invention.

Depicted in FIG. 5 is a similar, yet alternative, embodiment for the charging apparatus that utilizes a segmented shield which is divided widthwise into a plurality of parallel segments, 132. Each of the segments is separated by a dielectric spacer, 134, having the same cross-section or U-shape as the shield segments. More importantly, segments 132 each have independently controllable sources of power, such that the potential applied to any of the elements, $V_s[x]$, may be varied independent of the potential applied to adjoining segments. Again, using x to depict the sequential location of a specific segment, the local ion current flowing to the photoreceptor for the scorotron embodiment may be characterized by the following equations:

$$I_p'[x]=I_p[x]-I_g, \qquad \text{Eq. 3}$$

where $$I_p[x]=I_c-I_s[x], \qquad \text{Eq. 5}$$

and where $I_s[x]$ represents the current flow to a specific segment x.

Figure 8:
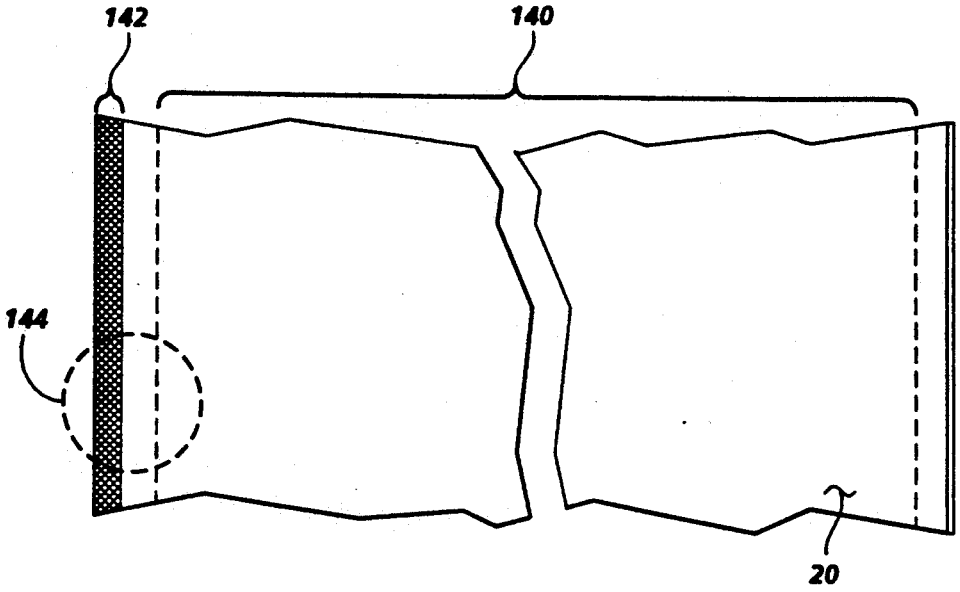
FIG. 8 is an illustration of a portion of a photoreceptor illustrating various regions on the surface thereof.

Turning briefly to FIG. 8, which illustrates a photoreceptor belt 20, the photoreceptor is generally coated with a photoconductive film layer within and extending slightly beyond a center imaging region 140, to form a usable imaging area thereon. Along one side, belt 20 further includes a ground strip region 142 which is uncoated by the photoresponsive layers present in the imaging region, and which allows the belt to be grounded by contacting brush 126 (FIG. 3), or a similar grounding device. Along both edges of imaging region 140, for example the region identified by reference numeral 144, there may be a characteristic "fall-off" in the thickness profile of the photoconductive layer present on the surface of the belt, as illustrated in FIG. 8. Coupled with the proximity of the ground strip, the thickness profile nonuniformity results in charge potential nonuniformity when charging is attempted with a common charging device such as a corotron. For example, a charge potential profile such as curve A in FIG. 10 might be observed when a corotron is used for charging, where the charge potential is proportional to the thickness of the photoconductive layer on belt 20. Conversely, the thickness profile would result in a charge density nonuniformity, such as that represented by curve B in FIG. 10, when a common scorotron is used for charging. However, using the charging apparatus tuning features of the present invention, it is possible to locally adjust the corona ion current flowing toward the surface of the photoreceptor in both scorotron and corotron charging devices to achieve a more uniform charge profile across the entire width of imaging area 140.

Figure 10:
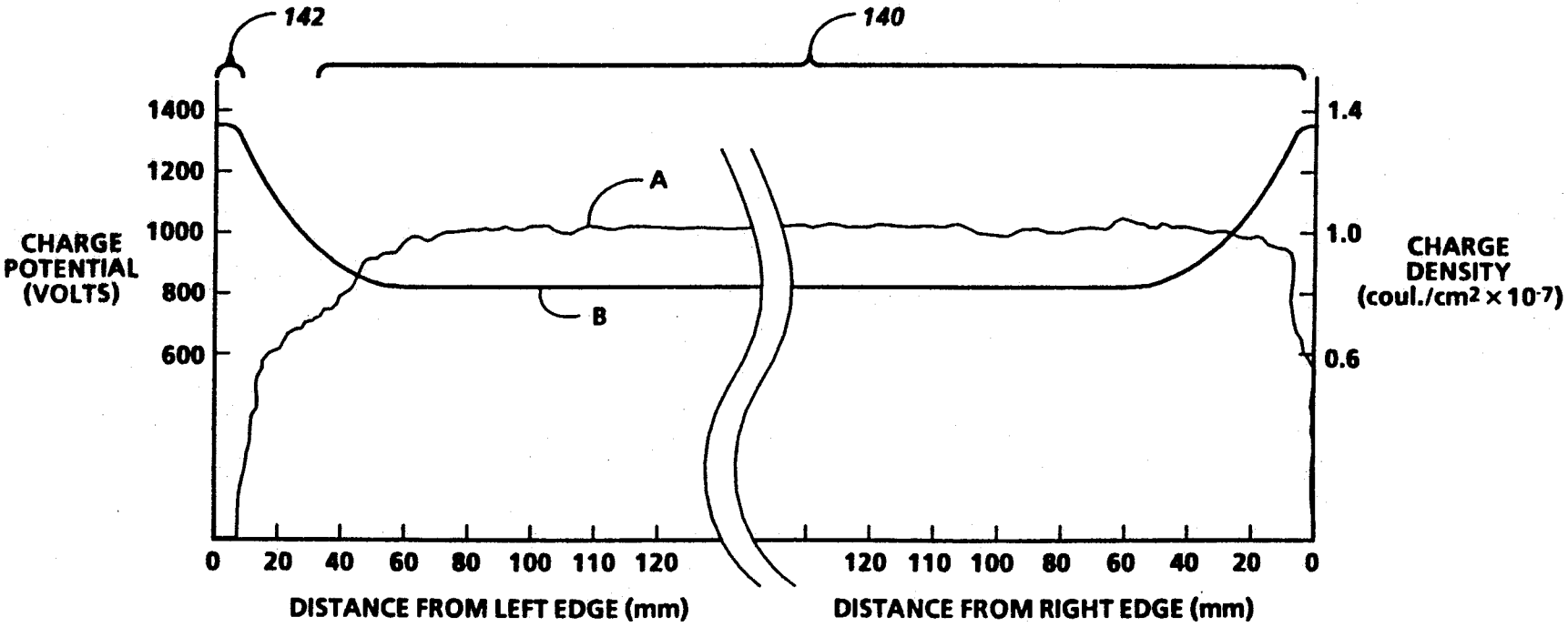

With the characteristic fall-off in charge profile exhibited in curves A and B of FIG. 10, the present invention may be used to charge a photoconductive belt having a nonuniform thickness so that a uniform charge density or charge potential would be achieved across the imaging area. For example, if a uniform charge potential profile were desired, the segmented shield scorotron embodiment just described could be used to increase the voltages of the end segments of the shield so as to attract less corona ions thereto, and thereby direct more of the ions toward the surface of the photoreceptor in the regions which typically exhibit lower charge densities. More specifically, assuming that the leftmost segment of the shield in FIG. 3 is located directly over the left edge of photoreceptor belt 20, and that the desired charge potential for the photoreceptor is approximately 1.0 kV, the voltage applied to the leftmost segment, $V_s[1]$, could be set at 1.4 kV. Similarly, $V_s[2]$ could be set at 1.3 kV, $V_s[3]$ at 1.2 kV, $V_s[4]$ at 1.1 kV, and the central segment $V_s[5]$ at the desired potential of 1.0 kV. Furthermore, the voltage potentials for the segments on the opposite end of the shield could be similarly set to account for inherent nonuniformity due to a thickness profile on the right edge of the photoreceptor belt as well. The resulting charge potential profile would be similar to that represented by curve C in FIG. 11, wherein the nonuniformity would be eliminated or at least substantially reduced so as to allow the photoreceptor within imaging region 140 to function under the critical charging requirements of a color xerographic engine.

Figure 9:
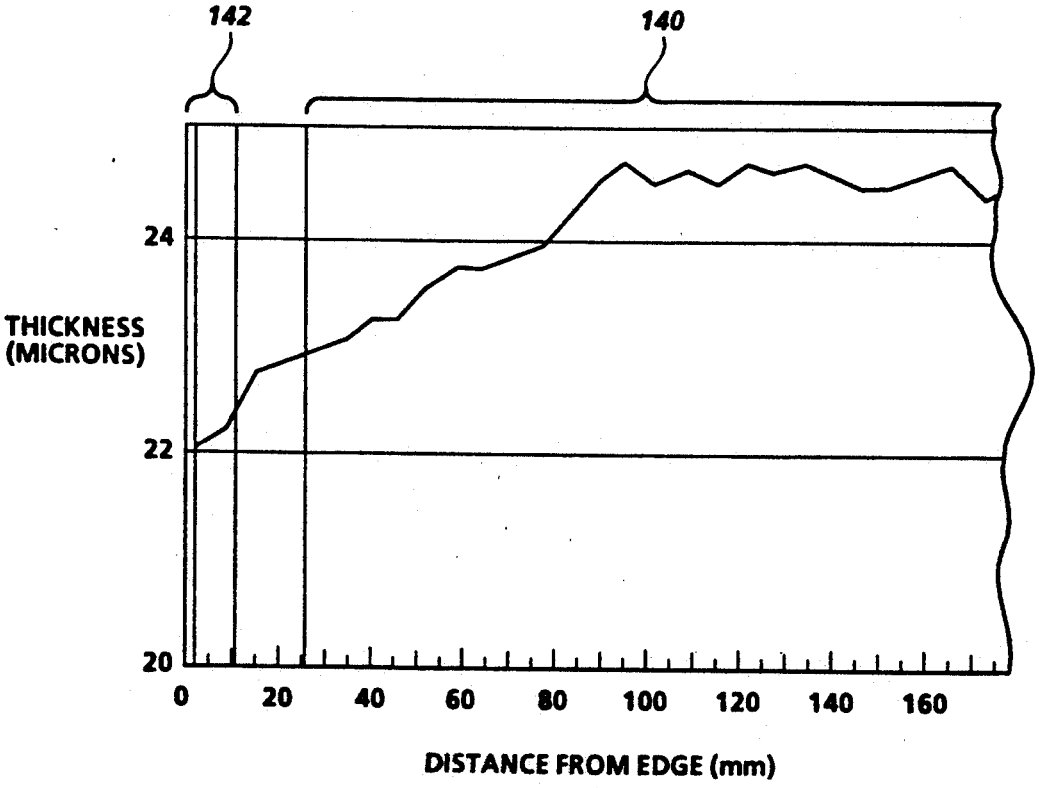
FIG. 9 is a graph illustrating the thickness profile of the photoreceptor depicted in FIG. 8.
Figure 11:
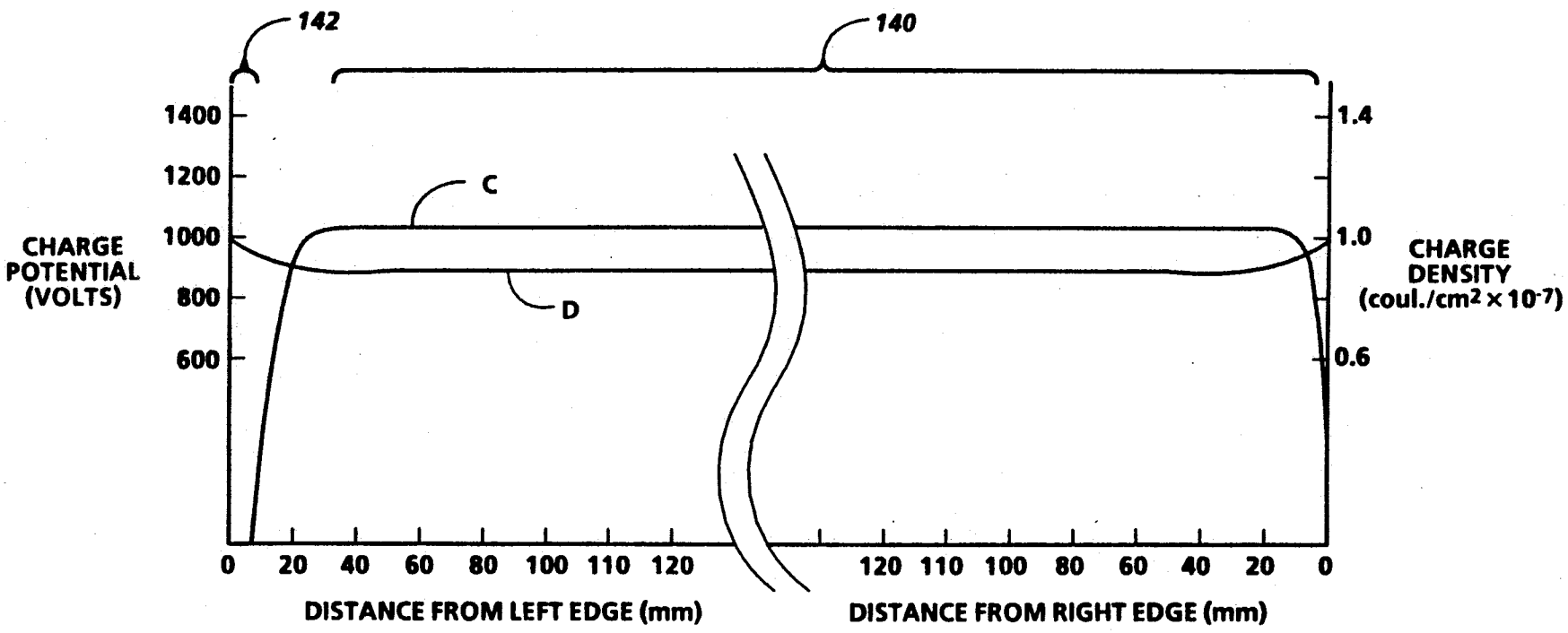
FIG. 11 is a graph illustrating voltage and charge profiles for a corotron or scorotron device employing the present invention.

On the other hand, if a uniform charge density were required over the surface of the photoconductor represented in FIG. 9, the outermost segments could be maintained at a potential lower than the inner segments, thereby attracting more ions toward the segments, and reducing the disparity in charge density resulting from the thickness profile along the edges of the photoconductor. For example, curve D in FIG. 11 represents a more uniform charge density profile that could be achieved using the variable potential segments previously described with respect to FIGS. 3 and 4.

Figure 6:
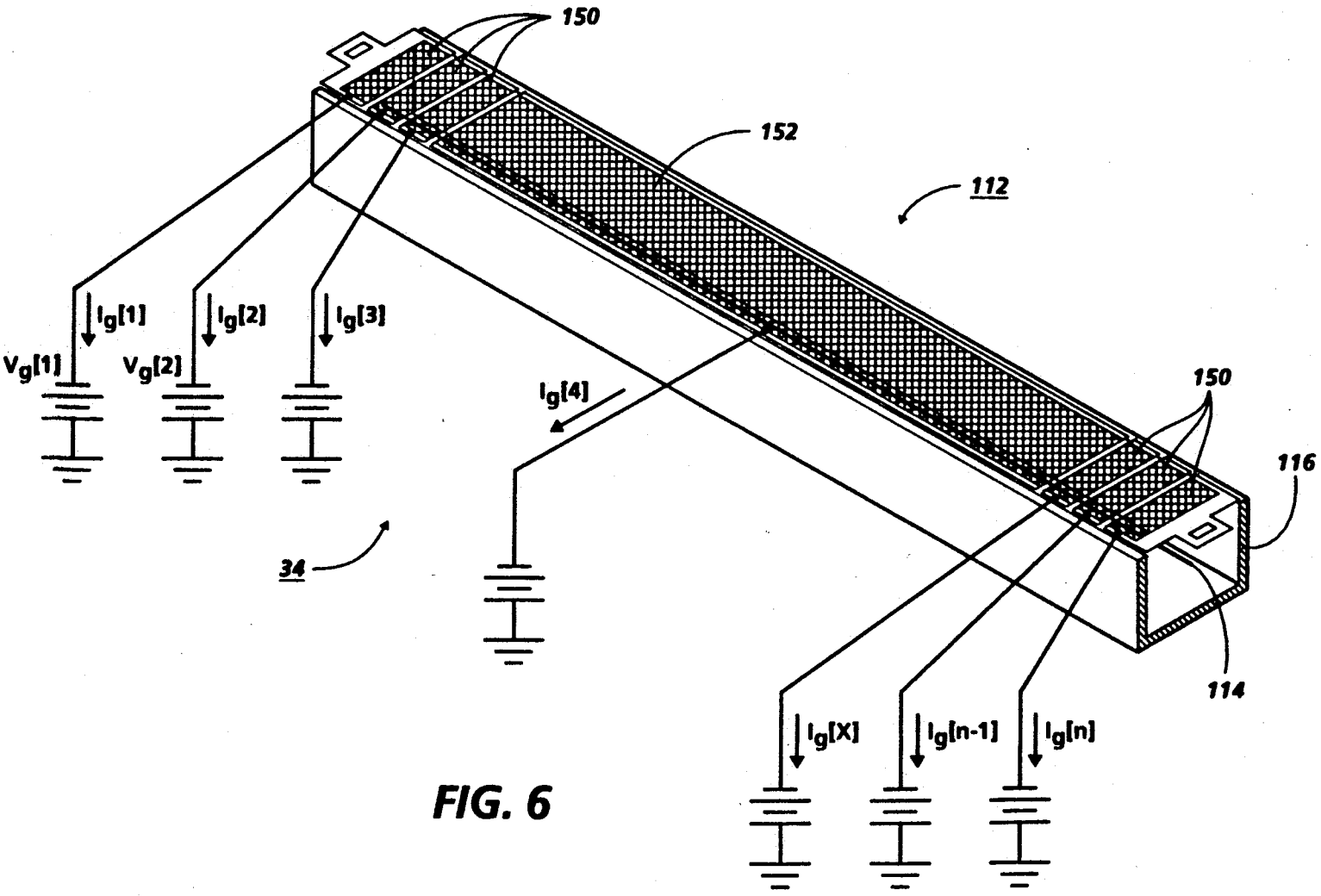
FIG. 6 is a perspective view of another alternative embodiment of the present invention.
Figure 7:
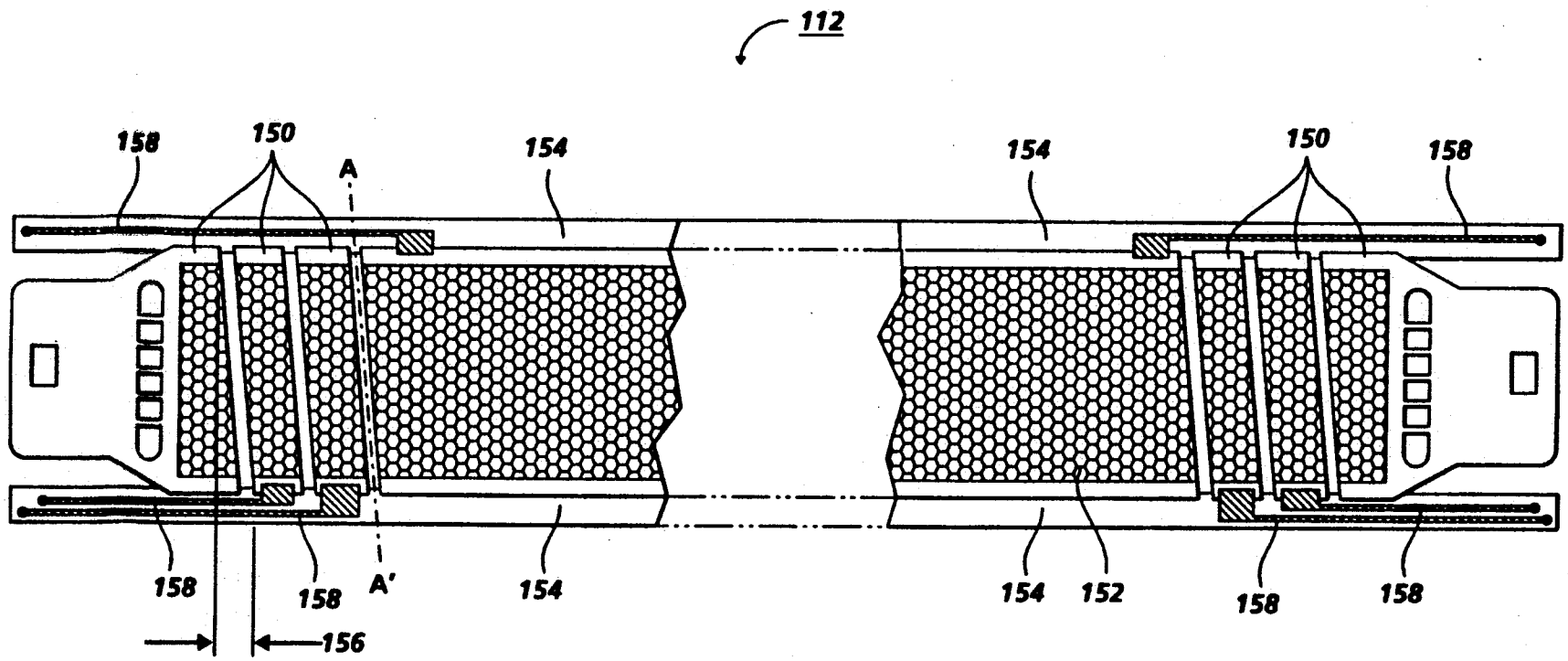
FIG. 7 is a top view of the segmented grid which is depicted in FIG. 6.

Referring next to FIGS. 6 and 7, where a third alternative embodiment of the present invention is shown for a scorotron charging apparatus only, scorotron grid 112 may be divided into electrically isolated segments to achieve the previously described local control of the corona ion current. More specifically, grid segments 150 may be individually biased by the power sources represented in FIG. 4A. Using notation similar to that used to describe the previous embodiments, the leftmost grid segment would be biased with a voltage $V_g[1]$. Moving to the right, the next element would be biased by potential $V_g[2]$ and so on. Again, because the central portion of the photoreceptor is typically chargeable to a uniform potential, a larger central grid segment, segment 152, would be maintained at potential $V_g[4]$, which would typically be about 1.0 kV, at or near the desired photoreceptor charge potential. Once again using x to depict the sequential location of any specific segment, the local ion current flowing to the photoreceptor may be characterized by the following equation:

$$I_p'[x]=I_p-I_g[x], \qquad \text{Eq. 6}$$

where $I_g[x]$ represents the current flow to a specific grid segment denoted by x. As indicated with respect to the previous embodiments as well, the grid segment will locally affect the flow of corona ions as a function of the voltage potential $V_g[x]$ applied thereto. Thus providing another method to locally regulate the corona ion current which is allowed to pass through the grid to charge the surface of the photoreceptor.

As illustrated in FIG. 7, the individual grid segments are not divided in a direction perpendicular to the longitudinal axis of the grid, rather they are divided so that there is an overlap of the segments in the process direction of the photoreceptor. While not a requirement, it is believed that dividing the segments along a slightly skewed direction, indicated as A—A', so as to produce a grid segment overlap represented by reference numeral 156, would eliminate any possibility for streaking that might be present if the segments are separated by a large gap. As further illustrated in FIG. 7, the individual segments of the grid may be supported in a fixed relationship by a nonconductive support means 154, located along both longitudinal edges thereof. Furthermore, support means 154 may be used as a substrate upon which conductive traces 158 may be deposited to provide electrical connections to the individual grid segments 150 and 152.

As an enhancement to any of the previously described embodiments, the localized or individual variation in any of the bias potentials, $V_e[x]$, $V_s[x]$, or $V_g[x]$, applied to the electrodes, shield segments or grid segments, respectively, may be automatically controlled to eliminate charge nonuniformity detected across the imaging area of belt 20. More specifically, individual power supplies, and their applied bias potentials, may be regulated by a control signal. The control signal may be generated in response to a manual operator input, performed at the user interface 14, or as an automated response to the detection of charge nonuniformity at the edges of the imaging region. While it is known that the charge nonuniformity is measurable using an electrostatic voltmeter, it is also possible to sense the result of the charge nonuniformity, namely, developed toner in the background regions along the edge of the photoreceptor, in the case of a discharged area development system. Using commonly known reflectance-type toner density measurements, for example, those described in U.S. Pat. No. 4,318,610 to Grace (Issued Mar. 9, 1982), hereby incorporated by reference for its teachings, the presence of developed toner could be detected along the edges of the imaging area on photoreceptor 20. In response to the detection of toner at the edges, the control signal would be generated to alter the bias potential applied to the local regulating element, be it electrode, shield segment or grid segment, until the reflectance had increased to a desirable level, evidenced by the elimination of unnecessarily developed toner in the background regions of the image area. Similarly, using an electrostatic voltmeter to monitor the potential levels on the surface of the photoreceptor at the edges of the imaging area, the control signal could be generated to alter the bias potentials as necessary to achieve more uniform charging, for example the charge profiles indicated by graphs C and D in FIG. 11.

In recapitulation, the present invention is a charging apparatus, either a scorotron or corotron, for locally altering the flow of corona ions from a corona generating element to the imaging surface of a photoreceptor in order to achieve a uniform charge potential across the usable portion of the surface. More specifically, the variable bias voltage applied to an individual element used to control the ion flow may be manually or automatically adjusted to reduce the nonuniformity detected on the photoreceptor surface.

It is, therefore, apparent that there has been provided, in accordance with the present invention, a charging apparatus for tuning or altering the charge potential applied to a charge receiving surface. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A charging apparatus adapted to apply a substantially uniform charge to a charge retentive surface, comprising:

corona producing means, spaced apart from the charge retentive surface, for emitting a corona ion current;

a grid, interposed between said corona producing means and the charge retentive surface, including a plurality of electrically isolated segments; and means, coupled to said segments, for applying a different bias voltage to at least two of said segments, whereby the differentially biased segments regulate the corona ion current passing therethrough to produce a substantially uniform charge on the charge retentive surface.

2. The charging apparatus of claim 1, wherein said grid segments are divided along an angle which is acute with respect to a processing direction of the charge retentive member so that a leading edge of one segment overlaps a trailing edge of an adjacent segment in a direction substantially transverse to the processing direction.

3. The charging apparatus of claim 2, wherein said grid comprises:

a first segment spanning, in a direction substantially transverse to the processing direction, a central region of the charge retentive surface; and a plurality of smaller segments located at opposite ends of said first segment.

4. A charging apparatus adapted to apply a substantially uniform charge to a charge retentive surface, comprising:

corona producing means, spaced apart from the charge retentive surface, for emitting a corona ion current;

a plurality of biasing electrode pairs located in proximity to said corona producing means, each electrode of said pair being spaced on opposite sides of said corona producing means outside of a region between said corona producing means and the charge retentive surface; and means for applying a different bias voltage to at least two of said electrode pairs to locally alter the ion current passing between said corona producing means and the charge retentive surface to produce a substantially uniform charge on the charge retentive surface.

5. The charging apparatus of claim 4, wherein said biasing electrodes are only located along opposite ends of said corona generating means.

6. A charging apparatus adapted to apply a substantially uniform charge to a charge retentive surface, comprising:

corona producing means, spaced apart from the charge retentive surface, for emitting a corona ion current;

a shield partially surrounding said corona producing means, said shield being divided widthwise into a plurality of electrically isolated segments, so that each shield segment is oriented in a direction parallel to a process direction of the charge retentive surface; and means for applying a different bias voltage to at least two of said plurality of shield segments to locally alter the ion current passing between said corona producing means and the charge retentive surface to produce a substantially uniform charge on the charge retentive surface.

7. The charging apparatus of claim 6, wherein said plurality of shield segments include:

a first segment spanning a central region of the charge retentive surface; and a plurality of smaller segments located at opposite ends of said first segment.

8. The charging apparatus of claim 7, wherein said applying means applies a first voltage to said first segment, and a bias voltage different from the first voltage to said plurality of smaller segments.

9. An electrophotographic imaging apparatus for producing a toned image, including:

a photoconductive member;

means for charging a surface of said photoconductive member to produce a uniform charge density across the surface thereof, including;

corona producing means, spaced apart from the surface of said photoconductive member, for emitting a corona ion current;

means for locally regulating the corona ion current passing between said corona producing means and the surface of said photoconductive member;

means for exposing the charged surface of said photoconductive member to record an electrostatic latent image thereon;

means for developing the electrostatic latent image recorded on said photoconductive member with toner to form a toned image thereon;

means for detecting a charge nonuniformity across the surface of said photoconductive member and generating a signal indicative thereof; and means for automatically adjusting said regulating means as a function of the signal from said detecting means.

10. The electrophotographic imaging apparatus of claim 9, wherein said detecting means comprises an electrostatic voltage meter traversing the surface of said photoconductive member.

11. The electrophotographic imaging apparatus of claim 9, wherein said detecting means comprises a reflective sensor which senses the presence of toner along an edge of said photoconductive member.

12. The electrophotographic imaging apparatus of claim 9, wherein said regulating means comprises:

a grid, interposed between said corona producing means and the surface of said photoconductive member, including a plurality of electrically isolated segments; and means, coupled to said segments, for applying a different bias voltage to at least two of said grid segments to locally regulate the ion current passing between said corona producing means and the surface of said photoconductive member to produce a substantially uniform charge on the charge retentive surface.

13. The electrophotographic imaging apparatus of claim 9, wherein said regulating means comprises:

a plurality of biasing electrode pairs located in proximity to said corona producing means, each electrode of said pair being spaced on opposite sides of said corona producing means outside of a region between said corona producing means and the charge retentive surface; and means, coupled to said electrode pairs, for applying a different bias voltage to at least two of said said electrode pairs to locally alter the ion current passing between said corona producing means and the surface of said photoconductive member to produce a substantially uniform charge on the charge retentive surface.

14. The electrophotographic imaging apparatus of claim 9, wherein said regulating means comprises:

a shield partially surrounding said corona producing means, said shield being divided widthwise into a plurality of electrically isolated shield segments, so that each shield segment is oriented in a direction parallel to a process direction of the photoconductive member; and means, coupled to said shield segments, for applying a different bias voltage to at least two of said plurality of shield segments to locally alter the ion current passing between said corona producing means and the surface of said photoconductive member to produce a substantially uniform charge on the charge retentive surface.

* * * * *